US005799706A

United States Patent [19]

Gabalda

[11] Patent Number: 5,799,706

[45] Date of Patent: Sep. 1, 1998

[54] WEAVING LOOM WITH VIBRATION DAMPER

[75] Inventor: Carlos Matas Gabalda, Granges les Valence, France

[73] Assignee: ICBT Diederichs, France

[21] Appl. No.: 860,177

[22] PCT Filed: Nov. 21, 1995

[86] PCT No.: PCT/FR95/01529

§ 371 Date: Jun. 18, 1997

§ 102(e) Date: Jun. 18, 1997

[87] PCT Pub. No.: WO96/23093

PCT Pub. Date: Aug. 1, 1996

[30] Foreign Application Priority Data

Jan. 26, 1995 [FR] France ..... 95 01137

[51] Int. Cl.[6] ..... D03D 49/02

[52] U.S. Cl. ..... 139/1 R; 248/562; 248/615; 267/140.13

[58] Field of Search ..... 139/1 R; 188/379, 188/378; 248/562, 615, 638; 267/140.13, 140.11

[56] References Cited

U.S. PATENT DOCUMENTS

| | | | |
|---|---|---|---|
| 1,173,538 | 2/1916 | Roberts | 248/615 |
| 3,332,646 | 7/1967 | Kellet . | |
| 3,633,706 | 1/1972 | Kennedy | 181/33 K |
| 3,868,975 | 3/1975 | Stahl et al. | 139/1 R |
| 4,699,180 | 10/1987 | Stefan et al. | 139/1 R |
| 5,038,835 | 8/1991 | Bryer | 139/1 R |
| 5,249,605 | 10/1993 | Graf | 139/91 |
| 5,307,844 | 5/1994 | Gruwez | 139/1 R |
| 5,316,048 | 5/1994 | Gruwez | 139/1 R |
| 5,322,088 | 6/1994 | Sampers et al. | 139/1 R |
| 5,351,719 | 10/1994 | Graf | 139/91 |

FOREIGN PATENT DOCUMENTS

| | | |
|---|---|---|
| 565934 | 3/1993 | European Pat. Off. . |
| 645484 | 9/1995 | European Pat. Off. . |
| 9208880 | 10/1992 | Germany . |

*Primary Examiner*—Andy Falik
*Attorney, Agent, or Firm*—Wall Marjama & Bilinski

[57] ABSTRACT

A weaving loom for forming a fabric that includes two vertically adjacent modules and a damping member mounted therebetween. The lower module contains a mechanism for unwinding warp yarn, forming the shed and unwinding the fabric. The upper module contains a mechanism for inserting the weft, controlling the reed and feeding the resulting fabric.

3 Claims, 1 Drawing Sheet

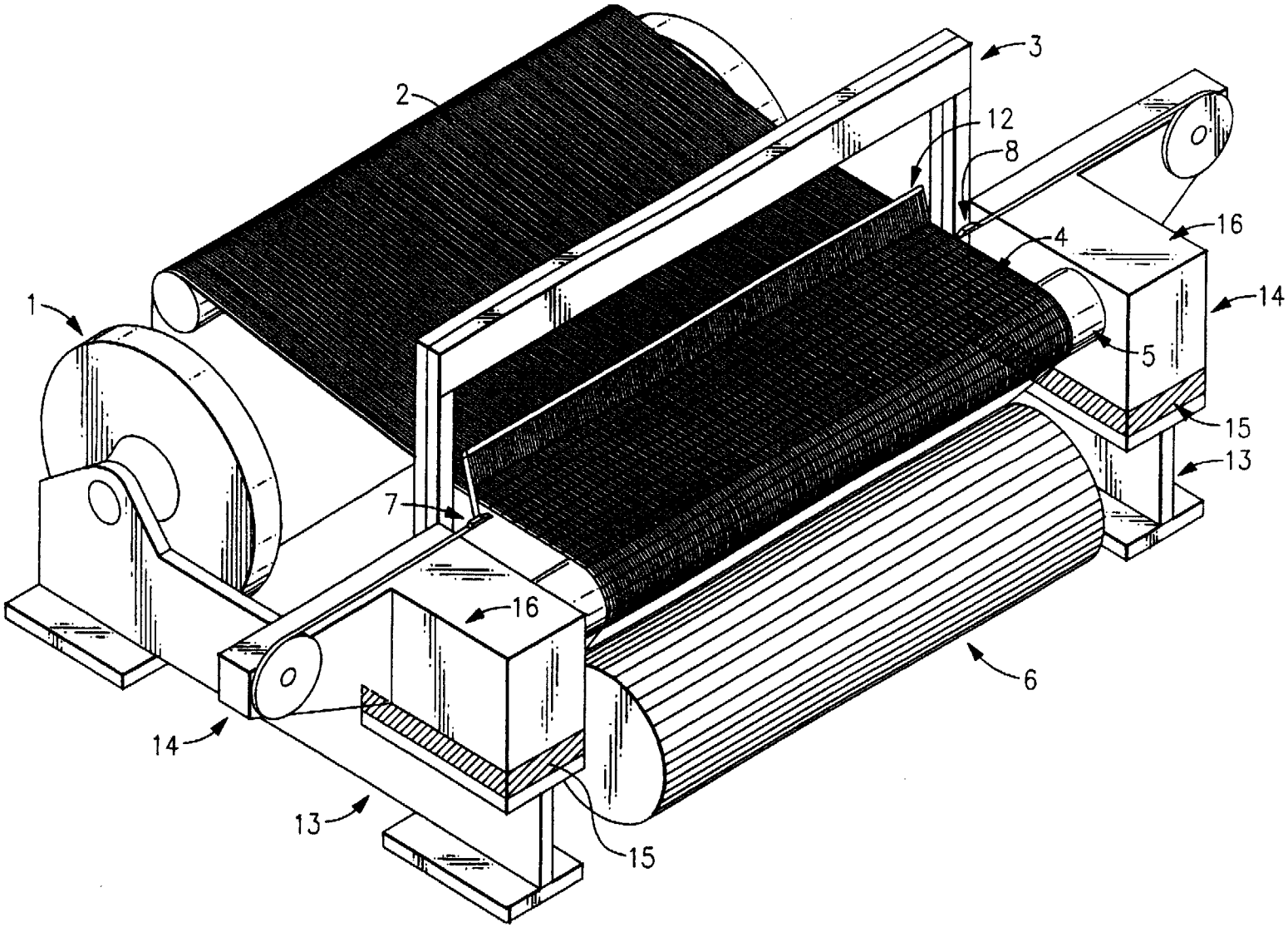
1
2
3
4
5
6
7
8
12
13
14
15
16

WEAVING LOOM WITH VIBRATION DAMPER

BACKGROUND OF THE INVENTION

The present invention relates to an improvement made to weaving looms, making it possible to reduce the vibrations and noise resulting from the weaving process.

In the rest of the description, the invention will be described with regard to a weaving loom, in which the weft is inserted by means of two grippers which are introduced simultaneously into the shed from each side of the loom. One grip per serving for delivering the weft yarn, taken from a bobbin located on one side of the machine, as far as the middle of the width of the latter, where there is then a transfer to the second gripper which, during its retraction, delivers the yarn on the side opposite the feed side. The displacements of the said grippers within the shed being ensured by an assembly commonly referred to by the expression "rapier or flexible band".

It is clear that this is not limiting and that the invention could equally be applied to other types of weaving looms employing means other than positive grippers for ensuring the insertion of the weft.

The production of a fabric involves:

on the one hand, ensuring the unwinding of the sheet of warp yarns, the formation of the shed and the winding-up of the fabric produced, and on the other hand, inserting the weft yarn when the shed is open and beating it against the last pick made by means of a reed carried by a lay.

It is well known that one of the main problems in weaving is the vibrations and noise level caused by the control and displacements of the various elements making it possible to carry out the abovementioned operations.

Hitherto, the only solution proposed for solving this problem has been to interpose damping systems between the floor and the lower part of the frame of the loom, although these are not entirely satisfactory.

Now a simple and effective solution, making it possible to solve these problems of vibration and noise satisfactorily, has been found, this being the subject of the present invention.

SUMMARY OF THE INVENTION

In general terms, the weaving loom according to the invention is characterized in that the means making it possible to form the fabric are grouped in two superposed modules, between which a damping element is interposed:

the lower module grouping the means ensuring the unwinding of the lap of warp yarns, the formation of the shed (dobby and drawing of the heald frames) and the winding-up of the fabric;

the upper module itself grouping the means ensuring the insertion of the weft, the control of the lay and the take-up of the fabric produced.

By virtue of such a structure, according to which damping is carried out between the members having differently (vertically and horizontally) oriented displacements, virtually all the vibrations are eliminated and the noise level is appreciably reduced.

In one embodiment according to the invention, the damping element interposed between the two modules consists, for example, of a layer of polyurethane having a thickness of approximately 20 mm.

BRIEF DESCRIPTION OF THE DRAWING

However, the invention will be better understood from the following exemplary embodiment illustrated by the single accompanying figure which is a simplified diagrammatic perspective view of a loom produced according to the invention.

DESCRIPTION OF THE INVENTION

Referring to this figure, the loom according to the invention is therefore composed, like all weaving looms, of a beam (1) for warp yarns (2), of heald frames (3), the number of which depends on the article to be produced and which make it possible to ensure the formation of the shed, of a take-up system (5) for the fabric (4) formed and of a roller for winding up (6) the said fabric. The warp yarns for forming the shed are controlled by any suitable means, such as, for example, by a dobby (not shown) ensuring the vertical displacements of the heald frames (3).

In the embodiment illustrated, the weft yarn is inserted by means of an assembly comprising two positive grippers (7, 8) arranged on each side of the loom and introduced simultaneously into the shed, the gripper (7) driving the weft yarn and transferring the end of the latter to the gripper (8) in the middle of the shed by transfer means delivering the weft on the other side of the loom.

The weft introduced against the last pick of the fabric (4) is packed by means of a reed (12) mounted on a lay.

Since all the abovementioned means are conventional means, they will not be described in detail for the sake of simplification.

According to the invention, and in order to reduce the phenomena of vibration and noise caused by the control and displacements of the abovementioned means for producing the fabric, the said means are grouped in two superposed modules designated respectively by the general references (13) and (14) the lower module (13) grouping the means ensuring the unwinding of the lap of warp yarns (2), the formation of the shed (dobby and drawing of the heald frames (3)) and the winding-up of the fabric (6). The upper module (14) itself is fastened to the lower module (13), a damping element (15) being interposed between the base of the upper module (14) and the corresponding bearing surface of the lower module (13).

This upper module (14) groups the means making it possible to ensure the insertion of the weft, the control of the lay supporting the reed (12) and the take-up (5) of the fabric formed. The control means are protected by housings (16) which may be soundproofed.

The rear part of the loom, comprising the beam (1), the yarn carrier, the warp stop motion, the guide for the frames (3) and the centre selvedges, may be mounted on a removable assembly capable of being fitted to the lower module (13) and making the article changing operations easier.

Such a loom structure making use of an elastic connection between the members having differently oriented displacements results in a lowering of the noise level of the loom in comparison with a similar loom which does not have a damping element.

I claim:

1. A weaving loom for manufacturing fabric that includes a pair of superposed modules that further includes, a lower module having means for ensuring unwinding of a lap of warp yarns, formation of a shed and winding up of the fabric and an upper module having means for ensuring insertion of a weft, control of a lay supporting a reed and taking up of the fabric, and a damping means interposed between the two modules.

2. The loom of claim 1 wherein the damping element includes a layer of polyurethane having a thickness of about 20 mm.

3. The loom of claim 2 wherein the upper and lower modules are superimposed one over the other and said layer of polyurethane is mounted between at least one top wall of the lower module and at least one bottom wall of the upper module.

* * * * *